US012698589B2

(12) United States Patent
Leksmon et al.

(10) Patent No.: US 12,698,589 B2
(45) **Date of Patent: *Aug. 4, 2026**

(54) OPTIMIZATION OF CHEMICAL CONSUMPTION IN BIOMASS DELIGNIFICATION

(71) Applicant: SixRing Inc., Calgary (CA)

(72) Inventors: Tenzin Leksmon, Calgary (CA); Leah Fraiberg, Calgary (CA); Emhemmed Youssef, Calgary (CA); Markus Weissenberger, Calgary (CA)

(73) Assignee: SixRing Inc., Calgary (CA)

( * ) Notice: Subject to any disclaimer, the term of this patent is extended or adjusted under 35 U.S.C. 154(b) by 96 days.

This patent is subject to a terminal disclaimer.

(21) Appl. No.: 18/437,611

(22) Filed: Feb. 9, 2024

(65) Prior Publication Data

US 2025/0052002 A1 Feb. 13, 2025

(30) Foreign Application Priority Data

Aug. 10, 2023 (CA) ..... CA 3208957

(51) Int. Cl.
*D21C 3/06* (2006.01)
*D21C 1/04* (2006.01)
(Continued)

(52) U.S. Cl.
CPC ..... *D21C 3/06* (2013.01); *D21C 1/04* (2013.01); *D21C 3/04* (2013.01); *D21C 3/222* (2013.01);
(Continued)

(58) Field of Classification Search
CPC ... D21C 3/04; D21C 1/04; D21C 9/16; D21C 3/26; D21C 3/222
See application file for complete search history.

(56) References Cited

U.S. PATENT DOCUMENTS

| | | | | |
|---|---|---|---|---|
| 11,982,051 | B2 * | 5/2024 | Weissenberger | D21C 3/003 |
| 2013/0251590 | A1 * | 9/2013 | Golden | A01N 59/00 422/24 |
| 2024/0052566 | A1 * | 2/2024 | Leksmon | D21C 7/08 |

FOREIGN PATENT DOCUMENTS

| | | | | |
|---|---|---|---|---|
| CA | 2450464 | C * | 12/2009 | D21B 1/16 |
| EP | 2390408 | A1 * | 11/2011 | D21C 9/16 |

(Continued)

*Primary Examiner* — Anthony Calandra
(74) *Attorney, Agent, or Firm* — PCFB, LLC; Justin K. Flanagan

(57) ABSTRACT

In one example, a process includes providing a system with a first vessel and a second vessel; providing a biomass comprising lignin, hemicellulose and cellulose fibers into said first vessel; providing an aqueous acidic composition comprising an acid; providing a modifier component; providing a peroxide component; exposing said biomass to said sulfuric acid, modifier and peroxide components, creating a reaction mass; mixing said reaction mass; and allowing said sulfuric acid component and peroxide component to come into contact with said biomass for a period of time sufficient to a delignification reaction to occur and remove a predetermined amount of said lignin from said biomass. The pre-determined amount may be assessed by determining a first remaining peroxide concentration in the reaction mass, with a suitable apparatus, when said first remaining peroxide concentration is reached, the biomass is transferred to said second vessel.

15 Claims, 3 Drawing Sheets

(51) Int. Cl.

| | |
|---|---|
| ***D21C 3/04*** | (2006.01) |
| ***D21C 3/22*** | (2006.01) |
| ***D21C 3/24*** | (2006.01) |
| ***D21C 3/26*** | (2006.01) |
| ***D21C 7/06*** | (2006.01) |
| ***D21C 7/08*** | (2006.01) |
| ***D21C 7/10*** | (2006.01) |
| ***D21C 7/12*** | (2006.01) |
| ***D21C 9/02*** | (2006.01) |
| ***D21C 9/16*** | (2006.01) |

(52) U.S. Cl.

CPC ..... *D21C 3/24* (2013.01); *D21C 3/266* (2013.01); *D21C 7/06* (2013.01); *D21C 7/08* (2013.01); *D21C 7/10* (2013.01); *D21C 7/12* (2013.01); *D21C 9/02* (2013.01); *D21C 9/16* (2013.01)

(56) References Cited

FOREIGN PATENT DOCUMENTS

| | | | | | |
|---|---|---|---|---|---|
| WO | WO-0159437 | A1 * | 8/2001 | ..... | D21C 7/12 |
| WO | WO-2010139589 | A1 * | 12/2010 | ..... | D21C 1/08 |

* cited by examiner

OPTIMIZATION OF CHEMICAL CONSUMPTION IN BIOMASS DELIGNIFICATION

RELATED APPLICATIONS

This application claims priority to Canadian Patent Application No. 3,208,957, titled "Optimization of Chemical Consumption in Biomass Delignification," filed on Aug. 10, 2023, which is hereby incorporated by reference in its entirety.

TECHNICAL FIELD

The present invention relates to a method and system for pulping biomass (referred to as "chips") in a treatment vessel, more specifically to perform a continuous pulping process under low operating conditions.

BACKGROUND

Petroleum- or fossil fuel-based products include a vast array of products, as surfactants, pharmaceuticals, plastics and elastomers which are abundant in all aspects of manufacturing consumer products and fuels which are used to power vehicles, homes and industries. Climate change and environmental pressures are forcing society to find alternatives to fossil fuels and petroleum-based products. A well-known source for non-petroleum-based products is lignocellulosic biomass. This is the single most abundant source of carbon-neutral organic materials on the planet and contains most of the required compounds to sustain multiple industries including, but not limited to, energy production, chemicals, food, pharmaceuticals, concrete, various manufacturing and agriculture applications.

There are billions of tons being produced by biosynthesis every year. However, to efficiently separate the three components of lignocellulosic biomass proves to be a challenge for it to be a strong and legitimate competitor or alternative to petroleum-based products. To benefit from lignocellulosic biomass and to be able to further use it, one must be able to separate out the lignin, from the hemicellulose and the cellulose. Cellulose is an abundant, high molecular weight natural fiber that possesses great strength and biodegradability. Depending on the feedstock, cellulose can make up from 30 to 60 percent or in some cases more of the plant material and is found in trees/forestry residue, algae, crops, straw, municipal and industrial waste, and various plants.

Furthermore, due to cellulose encasement between lignin and hemicellulose, the efficient and commercially viable extraction of cellulose will depend greatly on the method and biomass source used during the extraction process. Many current and proposed processing methods may limit the use or alter the structural integrity of the cellulose resulting in a marginal yield and excessive processing costs. In general, cellulose extracted from plant materials contains both an amorphous region and a crystalline region.

It is widely agreed that the technical difficulties in the processes, which are currently inefficient, expensive and difficult to scale, of separating lignin and hemicellulose from the cellulose in the biomass is what prevents such technology from being a viable alternative for petroleum-based or fossil fuel products.

The first step in paper production and most energy-intensive one is the production of pulp. Notwithstanding water, wood and other plant materials used to make pulp contain three main components: cellulose fibers; lignin; and hemicelluloses. Pulping has a primary goal to separate the fibers from the lignin. Lignin is a three-dimensional cross-linked polymer which figuratively acts as a mortar to hold all the fibers together within the plant. Its presence in finished pulp is undesirable and adds nothing to the finished product. Pulping wood refers to breaking down the bulk structure of the fibre source, be it chips, stems or other plant parts, into the constituent fibres. The cellulose fibers are the most desired component when papermaking is involved. Hemicelluloses are shorter branched carbohydrate polymers consisting of various monosacharides which form a random amorphous polymeric structure. The presence of hemicellulose after biomass conversion is less desirable as biomass conversion requires the further breakdown to monosacharides as a desired outcome while a pulp & paper process normally stops right after lignin dissolution. In fact, hemicellulose is desired in finished pulp as it acts much like a glue for the cellulose fibers during papermaking.

There are two main approaches to preparing wood pulp or woody biomass: mechanical treatment and chemical treatment. Mechanical treatment or pulping generally consists of mechanically tearing the wood chips apart and, thus, tearing cellulose fibres apart in an effort to separate them from each other. The shortcomings of this approach include: broken cellulose fibres, thus shorter fibres and lignin being left on the cellulose fibres thus being inefficient or non-optimal. This process also consumes large amounts of energy and is capital intensive. There are several approaches included in chemical pulping. These are generally aimed at the degradation of the lignin and hemicellulose into small, water-soluble molecules. These now degraded components can be separated from the cellulose fibres by washing and filtering the latter without depolymerizing the cellulose fibres. The chemical process is currently energy intensive as well as high amounts of heat and/or higher pressures are typically required; in many cases, agitation or mechanical intervention are also required, further adding inefficiencies and costs to the process.

There exist pulping or treatment methods which combine, to a various extent, the chemical aspects of pulping with the mechanical aspects of pulping. To name a few, one must consider thermomechanical pulping (also commonly referred to as TMP), and chemi-thermomechanical pulping (CTMP). Through a selection of the advantages provided by each general pulping method, the treatments are designed to reduce the amount of energy required by the mechanical aspect of the pulping treatment. This can also directly impact the strength or tensile strength degradation of the fibres subjected to these combination pulping approaches. Generally, these approaches involve a shortened chemical treatment (compared to conventional exclusive chemical pulping) which is then typically followed by mechanical treatment to separate the fibres.

The most common process to make pulp for paper production is the kraft process. In the kraft process, wood chips are converted to wood pulp which is almost entirely pure cellulose fibers. The multi-step kraft process consists of a first step where wood chips are impregnated/treated with a chemical solution. This is done by soaking the wood chips and then pre-heating them with steam. This step swells the wood chips and expels the air present in them and replaces the air with the liquid. This produces black liquor a resultant by-product from the kraft process. It contains water, lignin residues, hemicellulose and inorganic chemicals. White liquor is a strong alkaline solution comprising sodium hydroxide and sodium sulfide. Once the wood chips have been soaked in the various chemical solutions, they undergo cooking. To achieve delignification in the wood chips, the cooking is carried out for several hours at temperatures reaching up to 176° C. At these temperatures, the lignin degrades to yield water soluble fragments. The remaining cellulosic fibers are collected and washed after the cooking step.

U.S. Pat. No. 5,080,756 teaches an improved kraft pulping process and is characterized by the addition of a spent concentrated sulfuric acid composition containing organic matter to a kraft recovery system to provide a mixture enriched in its total sulfur content that is subjected to dehydration, pyrolysis and reduction in a recovery furnace. The organic matter of the sulfuric acid composition is particularly beneficial as a source of thermal energy that enables high heat levels to be easily maintained to facilitate the oxidation and reduction reactions that take place in the furnace, thus resulting in the formation of sulfide used for the preparation of cooking liquor suitable for pulping.

Caro's acid, also known as peroxymonosulfuric acid ($H_2SO_5$), is one of the strongest oxidants known. There are several known reactions for the preparation of Caro's acid but one of the most straightforward involves the reaction between sulfuric acid ($H_2SO_4$) and hydrogen peroxide ($H_2O_2$). Preparing Caro's acid in this method allows one yield in a further reaction potassium monopersulfate (PMPS) which is a valuable bleaching agent and oxidizer. While Caro's acid has several known useful applications, one noteworthy is its use in the delignification of wood. For the pulping of bagasee, it has been proposed as part of a two-stage pulping technique (sodium hydroxide stage followed by Caro's acid stage) or a three-stage pulping technique (sodium hydroxide stage followed by Caro's acid stage which is followed by another sodium hydroxide stage).

Other methods have been developed for pretreating lignocellulosic feedstocks. These pretreatment methods include dilute acid pretreatment, steam explosion ($CO_2$ explosion), pH-controlled water pretreatment, ammonia fibre expansion, ammonia recycle percolation (ARP), and lime pretreatment (Mosier et al. 2005; Wyman et al. 2005; Yang and Wyman 2008). One approach involves the concept of organosolv. Organosolv pulping is the process to extract lignin from ligocellulosic feedstocks with organic solvents or their aqueous solutions. Organosolv pulping has attracted interest since the 1970's because the conventional pulping processes, kraft and sulfite processes, have some serious shortcomings such as air and water pollution. Organosolv pretreatment is similar to organosolv pulping, but the degree of delignification for pretreatment is not expected/required to be as high as that of pulping. However, a drawback of organosolv pre-treatment is the high temperatures at which the processes are known to be carried out at, upwards of 100-250° C., often times in the range of 185-210° C. Such temperatures require high energy inputs.

Improved processes for delignification need to take into account environmental aspects as well as end-product generation. Ambient temperature processes (20-25 degrees Celsius) are highly desirable as they do not require energy intensive inputs. However, to carry out delignification operations at low temperatures and atmospheric pressure, strong acids are typically required. The strength of the acids used while sufficient to remove lignin present on the lignocellulosic feedstock, can be deleterious to the lignin as it decomposes it beyond any lignin monomers which would be useable in other industries or applications, but can also damage the cellulose being yielded and therefore fail in delivering useable products from said feedstock. A common drawback of using strong acids on cellulose includes darkening of the cellulose. The acids act as dehydrating agents that remove water molecules from the cellulose and leave behind carbon residues during a highly exothermic reaction. which indicates that glucose units present the cellulose have been destroyed leaving the carbon behind.

Biofuel production is another potential application for the kraft process. One of the current drawbacks of biofuel production is that it requires the use of food grade plant parts (such as seeds) in order to transform carbohydrates into fuel in a reasonably efficient process. The monosaccharides (mainly glucose) could be obtained from cellulosic fibers, by using non-food grade biomass in the kraft process; however, the energy intensive nature of the kraft process for delignification makes this a less commercially viable option. In order to build a plant based chemical resource cycle, there is a great need for energy efficient processes which can utilize plant-based feedstocks that don't compete with human food production.

In addition to the recovery of cellulose, the recovery of lignin is increasingly important. Most conversion technologies relating to dissolved lignin use heat and metal catalysts to effectively break down lignin into low molecular weight aromatics which hold value for other uses/applications across industry. Some of the considerations to take into account when exploring various processes include: efficiency of the catalysts used; the stability of the catalysts; Catalyst selectivity; control of the condensation and repolymerization reactions of lignin. The condensation and repolymerization of lignin often yield products which cannot be broken down easily using the conventional approaches and therefore lose a tremendous amount of value in terms of future uses/applications in industry. The condensation and repolymerization of lignin have a direct impact on the recovery of target lignin products (such as low molecular weight phenolic compounds). Thus, avoiding the condensation and repolymerization reactions is critical in order to maximize the yields of the target products.

The lignin repolymerization has been a substantial concern during many stages of the process of the delignification of lignocellulosic biomass. Conventional fractionation process, namely biomass pre-treatment, focuses on its effectiveness to remove lignin from biomass structure, generally employing acid or base catalysts. The resulting residual solid, mainly lignin, significantly undergoes irreversible repolymerization depending on the pre-treatment conditions. This is an outcome which must be avoided in order to extract maximum value from a treatment which is geared at recovering both cellulose and lignin for future uses.

While the kraft pulping process is the most widely used chemical pulping process in the world, it is extremely energy intensive and has many drawbacks, for example, substantial odours emitted around pulp producing plants or general emissions that are now being highly regulated in many pulp and paper producing jurisdictions. In light of the current environmental, economic and climactic changes, along with emission fees being implemented, it is highly desirable to optimize the current pulping processes. In order to provide at least linear quality fibres without the current substantial detriment to the environment during the production thereof. Accordingly, there still exists a need for a composition capable of performing delignification on wood substance under reduced temperatures and pressures versus what is currently in use without requiring any additional capital expenditures.

Accordingly, there still exists a need for a system and a process capable of performing delignification on lignocellulosic biomass under reduced temperatures and pressures versus what is currently in use without requiring any major additional capital expenditures and adapted to preserve the lignocellulosic biomass constituents as much as possible for further applications. The inventors have developed an improved delignification system and process which is more in line with the increasing environmental constraints and regulations which are put in place by governments across the globe.

SUMMARY

According to a preferred embodiment of the present invention, the process utilizes a process of chemical impregnation of biomass with a chemical blend which uses the reaction heat (reaction enthalpy) released during the reaction to increase the temperature of the reaction mixture. Preferably, there is very little external heat as input into the reaction mixture. This distinguishes the present process from conventional pulping processes such as kraft pulping.

According to a preferred embodiment of the present invention, the consumption of peroxide has been such that the initial concentration of peroxide in the reaction mass was in the range of approximately 10%, and following the reaction, the concentration of peroxide was roughly 2%. Without the implementation of a continuous process such as the one described according to the present invention, the consumption of peroxide is much greater, which in turn, leads to a larger volume of such being wasted and hence higher operating costs and related costs.

Semi Continuous Unit Series

According to a preferred embodiment of the present invention, the process utilizes a system comprising a single reactor separated into multiple stages. Preferably, the process utilizes a system comprising a single reactor separated in 3 stages. According to another preferred embodiment, the reactor can comprise up to 6 stages.

Each stage comprises a variety of components but which are more readily identified by their residence time being mainly dictated by the remaining peroxide concentration in the reaction mixture which needs to be achieved to move on to a subsequent stage. The remaining peroxide concentration in the reaction mixture is one of the ways the extent of lignin depolymerization can be measured after pulping. It is used to assess the effectiveness of a pulping stage which typically results in partial delignification of the pulp. Conventionally, the extent of delignification is measured to determine the amount of chemicals necessary prior to performing a bleaching step of the pulp in a conventional process such as kraft.

The remaining peroxide concentration in the reaction mixture are assessed by testing a sample of fluid from the vessel after a pre-determined period of pulping time based on several factors including but not limited to feedstock type, feed stock size, temperature, to name a few. An advanced process control system equips the reactor with the required control plan. Preferably, the control system links the information regarding the remaining peroxide concentration in the reaction mixture, temperature, flow rate and residence time and adjusts the process variables according to the set points and transfer of reactants from one stage to the next one. Implementation of a system according to a preferred embodiment of the present invention and accompanying process allows to achieve a full or substantially full delignification of the input biomass feedstock as well as an optimal consumption of chemicals. Preferably, when the process controls are optimized and the reaction mixture transfers between the reaction vessels are performed seamlessly, the system acts much like a continuous process reactor.

According to a preferred embodiment of the present invention, there is provided a system comprising at least two vessels adapted to receive biomass and a delignification liquid; wherein said at least two vessels are placed in succession.

Semi Continuous Unit Stacked

According to another preferred embodiment of the present invention, there is provided a system for the continuous delignification of biomass. Preferably, said system comprises at least two in-line vessels, where a delignification reaction occurs. Preferably, said system comprises a first vessel operating at a first temperature, where said biomass is mixed with an acidic delignification composition having a known peroxide concentration until a first remaining peroxide concentration in the reaction mass is reached.

Preferably, once the reaction mass reaches a pre-determined first remaining peroxide concentration the biomass is then transferred to a second vessel where the delignification reaction occurs at a second temperature which is set slightly higher than said first temperature to speed up the reaction via increasing the reaction rate. Said reaction mass continues to be mixed with said delignification composition for a pre-determined time or until a pre-determined second remaining peroxide concentration is reached. Preferably, once the reaction mass reaches said second remaining peroxide concentration, reaction mass is then transferred to a third vessel where the delignification reaction occurs at a third temperature which is set slightly higher than said second temperature. Said reaction mass having said second remaining peroxide concentration continues to be mixed with said delignification composition for a pre-determined time or until the peroxide concentration remaining in the reaction mixture reaches less than 2%, more preferably less than 1%, even more preferably less than 0.5% and yet even more preferably near zero concentration.

According to a preferred embodiment of the present invention, the system further comprises of a temperature indicator/controller which is designed to monitor changes in temperature set point and feed data into the APC (Advance process control) to maintain desired conditions According to a preferred embodiment of the present invention, the system further comprises jet nozzles on the center main piping system which are designed to provide mixing of the biomass & chemical solution inside the vessel.

According to a preferred embodiment of the present invention, the system further comprises an extraction screen for the liquid chemical solution which is designed to extract chemical solution from the vessel to pump into jet nozzles and the external heat exchanger According to a preferred embodiment of the present invention, the system further comprises a Heat/Cooling Jacket which is designed to be a secondary temperature control method for maintaining the temperature setpoint.

According to a preferred embodiment of the present invention, the system further comprises an actuated discharge valve which is designed to discharge product slurry into the next stage once inline analyzers meet conditions or based on a pre-determined time According to a preferred embodiment of the present invention, the system further comprises a heat exchanger designed to be the primary method to chill or heat solution to the desired setpoint.

According to a preferred embodiment of the present invention, the system further comprises a central main piping system which is a piping system designed to distribute the chemical solution to biomass and chemical blend inside the vessel.

According to a preferred embodiment of the present invention, the system further comprises a Kappa analyzer at each stage/vessel to determine the pulping percentage of biomass According to a preferred embodiment of the present invention, the system further comprises at least one tank baffle which is designed to increase mixing efficiency as well as increase cooling/heating surface area by acting as a tertiary temperature control by allowing heat/cool fluid to enter via baffle.

According to a preferred embodiment of the present invention, the system further comprises a cone bottom which is desirable for easier reaction mixture discharging from one vessel to the next.

According to a preferred embodiment of the present invention, the system further comprises a top mount agitator which is designed to provide the desired agitation to the reaction mixture.

According to yet another aspect of the present invention, there is provided a process to delignify biomass, said process comprises the steps:

- providing a vessel;
- providing biomass comprising lignin, hemicellulose, and cellulose fibers into the said vessel;
- providing an aqueous acidic composition comprising a sulfuric acid component;
- providing a peroxide component;
- providing a modifier component (such as Taurine, TEOA, MSA, etc.)
- exposing said biomass to said sulfuric acid source, said peroxide component and said modifier component, creating a reaction mass;
- allowing said sulfuric acid source and peroxide component to come into contact with said biomass for a time sufficient for a delignification reaction to occur and remove over 90 wt % of said lignin and hemicellulose from said biomass; and
- controlling the temperature of the delignification reaction by controlling the addition of biomass into said vessel.

Operating Conditions

According to a preferred embodiment of the present invention, the temperature of the reaction mass is kept below 55° C. for the duration of the delignification reaction. The gauge pressure is kept below 14 psi. Preferably, the temperature of the reaction mass is kept below 50° C. for the duration of the delignification reaction. Preferably, the temperature of the reaction mass is kept below 45° C. for the duration of the delignification reaction. Preferably, the reaction temperature is controlled in the 30-45° C. range to achieve optimum reaction time, and at least 90% delignification. According to a preferred embodiment of the present invention, the temperature of the reaction mass is kept below 55° C. as a maximum upper temperature, as it has been noted that above this temperature the reaction tends to run away and becomes more difficult to control with external temperature controls. If the reaction temperature goes up too fast it can become necessary to add water to control or kill the reaction. Preferably, the reaction temperature is kept between 3° and 45° C. and even more preferably from 35 to 40° C.

According to a preferred embodiment of the present invention, the initial temperature of the reaction mass is no more than 40° C. and does not exceed 55° C. for the duration of the delignification reaction. Preferably, the initial temperature of the reaction mass is no more than 35° C. and does not exceed 55° C. for the duration of the delignification reaction. More preferably, the initial temperature of the reaction mass is no more than 30° C. and does not exceed 55° C. for the duration of the delignification reaction. Preferably also, the initial temperature of the reaction mass is no more than 25° C. and does not exceed 55° C. for the duration of the delignification reaction.

Emergency Water Control

According to a preferred embodiment of the present invention, the temperature of the reaction mass is controlled throughout the delignification reaction to subsequent additions of a solvent (water) to progressively lower the slope of temperature increase per minute from less than 1° C. per minute to less than 0.5° C. per minute.

According to another preferred embodiment of the present invention, the temperature of the mixture reaction mass is controlled by addition of a solvent (water) to reduce the slope of temperature increase per minute of the reaction mass to less than 1° C. per minute.

According to yet another preferred embodiment of the present invention, the temperature of the mixture reaction mass is controlled by the second addition of a solvent (water) to reduce the slope of temperature increase per minute of the reaction mass to less than 0.7° C. per minute.

Preferably, the temperature of the reaction mass is controlled by the third addition of a solvent (water) to reduce the slope of temperature increase per minute of the reaction mass to less than 0.3° C. per minute.

Preferably, the temperature of the reaction mass is controlled by the fourth addition of a solvent (water) to reduce the slope of temperature increase per minute of the reaction mass to less than 0.1° C. per minute.

Delignification Rate

According to a preferred embodiment of the present invention, the remaining peroxide concentration of the reaction mixture will correlate with a 90% delignification of the biomass feedstock.

Preferably, the remaining peroxide concentration of the reaction mixture will correlate with a 95% delignification of the biomass feedstock. More preferably, the remaining peroxide concentration of the reaction mixture will correlate with a 97.5% delignification of the biomass feedstock. Even more preferably, the remaining peroxide concentration of the reaction mixture will correlate with a 98.5% delignification of the biomass feedstock.

According to a preferred embodiment of the present invention, there is provided a process to delignify biomass using an aqueous acidic composition comprising:

- sulfuric acid;
- a modifier (Taurine/TEOA/MSA, heterocyclic compound, etc.);
- a peroxide.

Chemical Blend Details and Delignification

According to yet another aspect of the present invention, there is provided a process to perform a controlled exothermic delignification of biomass, said process comprising the steps:

- providing a vessel that is stainless steel or carbon steel with a corrosion resistant coating;
- providing biomass comprising lignin, hemicellulose, and cellulose fibers into the said vessel;
- providing a modified Caro's acid composition selected from the group consisting of: composition A; composition B; and Composition C;
- wherein said composition A comprises:

sulfuric acid in an amount ranging from 20 to 70 wt % of the total weight of the composition;

a modifier compound comprising an amine moiety and a sulfonic acid moiety selected from the group consisting of: taurine; taurine derivatives; and taurine-related compounds; and a peroxide;

wherein said composition B comprises:

an alkylsulfonic acid; and a peroxide; wherein the acid is present in an amount ranging from 40 to 80 wt % of the total weight of the composition and where the peroxide is present in an amount ranging from 10 to 40 wt % of the total weight of the composition;

wherein said composition C comprises:

sulfuric acid;

a two-part modifier comprising:

a compound comprising an amine moiety; and a compound comprising a sulfonic acid moiety; and a peroxide;

exposing said biomass to said modified Caro's acid composition, creating a reaction mass;

allowing said modified Caro's acid composition to come into contact with said biomass for a while sufficient for a delignification reaction to occur and remove over 90 wt % of said lignin and hemicellulose from said biomass; and controlling the temperature of the delignification reaction to maintain it below 55° C. by a method selected from the group consisting of:

adding water into the said vessel;

adding biomass into the said vessel; and using a heat exchanger.

According to a preferred embodiment of the present invention, the aqueous acidic composition combines both the sulfuric acid component and the peroxide component and, as such, comprises:

a modified Caro's acid composition selected from the group consisting of composition A; composition B and composition C;

wherein said composition A comprises:

sulfuric acid in an amount ranging from 20 to 70 wt % of the total weight of the composition;

a modifier compound comprising an amine moiety and a sulfonic acid moiety selected from the group consisting of: taurine; taurine derivatives; and taurine-related compounds; and a peroxide;

wherein said composition B comprises:

an alkylsulfonic acid; and a peroxide; wherein the acid is present in an amount ranging from 40 to 80 wt % of the total weight of the composition and where the peroxide is present in an amount ranging from 10 to 40 wt % of the total weight of the composition;

wherein said composition C comprises:

sulfuric acid;

a two-part modifier comprising:

a compound comprising an amine moiety; and a compound comprising a sulfonic acid moiety; and a peroxide.

According to a preferred embodiment of the present invention, said sulfuric acid, said compound comprising an amine moiety and a sulfonic acid moiety, and said peroxide is present in a molar ratio of no less than 1:1:1.

According to a preferred embodiment of the present invention, said sulfuric acid, said compound comprising an amine moiety and a sulfonic acid moiety, and said peroxide is present in a molar ratio of no more than 15:1:1.

According to a preferred embodiment of the present invention, said sulfuric acid and said compound comprising an amine moiety and a sulfonic acid moiety is present in a molar ratio of no less than 3:1.

According to a preferred embodiment of the present invention, said compound comprising an amine moiety and a sulfonic acid moiety is selected from the group consisting of: taurine; taurine derivatives; and taurine-related compounds.

According to a preferred embodiment of the present invention, said taurine derivative or taurine-related compound is selected from the group consisting of: taurolidine; taurocholic acid; tauroselcholic acid; tauromustine; 5-taurinomethyluridine and 5-taurinomethyl-2-thiouridine; homotaurine (tramiprosate); acamprosate; and taurates; as well as aminoalkylsulfonic acids where the alkyl is selected from the group consisting of $C_1$-$C_5$ linear alkyl and $C_1$-$C_5$ branched alkyl. Preferably, said linear alkylaminosulfonic acid is selected form the group consisting of: methyl; ethyl (taurine); propyl; and butyl.

Preferably, said branched aminoalkylsulfonic acid is selected from the group consisting of: isopropyl; isobutyl; and isopentyl.

According to a preferred embodiment of the present invention, said compound comprising an amine moiety and a sulfonic acid moiety is taurine.

According to a preferred embodiment of the present invention, said sulfuric acid and compound comprising an amine moiety and a sulfonic acid moiety are present in a molar ratio of no less than 3:1.

According to a preferred embodiment of the present invention, said compound comprising an amine moiety is an alkanolamine is selected from the group consisting of: monoethanolamine; diethanolamine; triethanolamine; and combinations thereof.

According to a preferred embodiment of the present invention, said compound comprising a sulfonic acid moiety is selected from the group consisting of: alkylsulfonic acids and combinations thereof.

According to a preferred embodiment of the present invention, said alkylsulfonic acid is selected from the group consisting of: alkylsulfonic acids where the alkyl groups range from $C_1$-$C_6$ and are linear or branched; and combinations thereof.

According to a preferred embodiment of the present invention, said alkylsulfonic acid is selected from the group consisting of: methanesulfonic acid; ethanesulfonic acid; propanesulfonic acid; 2-propanesulfonic acid; isobutylsulfonic acid; t-butylsulfonic acid; butanesulfonic acid; iso-pentylsulfonic acid; t-pentylsulfonic acid; pentanesulfonic acid; t-butylhexanesulfonic acid; and combinations thereof.

According to a preferred embodiment of the present invention, said alkylsulfonic acid; and said peroxide are present in a molar ratio of no less than 1:1.

According to a preferred embodiment of the present invention, said compound comprising a sulfonic acid moiety is methanesulfonic acid.

According to a preferred embodiment of the present invention, in Composition C, said sulfuric acid and said a compound comprising an amine moiety and said compound comprising a sulfonic acid moiety are present in a molar ratio of no less than 1:1:1.

According to a preferred embodiment of the present invention, in Composition C, said sulfuric acid, said compound comprising an amine moiety and said compound comprising a sulfonic acid moiety are present in a molar ratio ranging from 28:1:1 to 2:1:1.

According to another preferred embodiment of the present invention, there is provided a process to delignify biomass using an aqueous acidic composition comprising:

sulfuric acid;

a heterocyclic compound; and wherein sulfuric acid and said a heterocyclic compound; are present in a molar ratio of no less than 1:1.

Preferably, the sulfuric acid and said heterocyclic compound are present in a molar ratio ranging from 28:1 to 2:1 More preferably, the sulfuric acid and heterocyclic compound are present in a molar ratio ranging from 24:1 to 3:1. Preferably, the sulfuric acid and heterocyclic compound are present in a molar ratio ranging from 20:1 to 4:1. More preferably, the sulfuric acid and heterocyclic compound are present in a molar ratio ranging from 16:1 to 5:1.

According to a preferred embodiment of the present invention, the sulfuric acid and heterocyclic compound are present in a molar ratio ranging from 12:1 to 6:1.

Also preferably, said heterocyclic compound has a molecular weight below 300 g/mol. Also preferably, said heterocyclic compound has a molecular weight below 150 g/mol. More preferably, said heterocyclic compound is a secondary amine. According to a preferred embodiment of the present invention, said heterocyclic compound is selected from the group consisting of: imidazole; triazole; and N-methylimidazole.

According to an aspect of the present invention, there is provided a process to delignify biomass, such as wood using an aqueous acidic composition comprising:

sulfuric acid;

a heterocyclic compound; and a peroxide.

wherein the sulfuric acid and the heterocyclic compound are present in a mole ratio ranging from 2:1 to 28:1.

Preferably, for a modified Caro's acid comprising TEOA/MSA, the molar composition is as follows: H2O:H2O2:H2SO4:TEOA:MSA in a molar ratio of 56:10:10:1:1.

According to another preferred embodiment of the present invention, the modified Caro's acid has the following composition H2O:H2O2:H2SO4:Taurine in a molar ratio of 18:10:10:1.

According to preferred embodiment of the present invention, the process can employ a modified Caro's acid (as disclosed in Canadian patent application 3,128,677) comprises: sulfuric acid; a modifying agent comprising a compound containing an amine group; and wherein sulfuric acid and said compound containing an amine group; are present in a molar ratio of no less than 1:1. Preferably, the sulfuric acid and said compound containing an amine group are present in a molar ratio ranging from 28:1 to 2:1. More preferably, the sulfuric acid and compound containing an amine group are present in a molar ratio ranging from 24:1 to 3:1. Preferably, the sulfuric acid and compound containing an amine group are present in a molar ratio ranging from 20:1 to 4:1. More preferably, the sulfuric acid and compound containing an amine group are present in a molar ratio ranging from 16:1 to 5:1. Preferably, the sulfuric acid and compound containing an amine group are present in a molar ratio ranging from 12:1 to 6:1. According to a preferred embodiment of the present invention, the modifying agent is selected in the group consisting of: TEOA; MEOA; pyrrolidine; DEOA; ethylenediamine; diethylamine; triethylamine; morpholine; MEA-triazine; and combinations thereof. According to a more preferred embodiment of the present invention, the modifying agent is TEOA; MEOA; pyrrolidine; DEOA; ethylenediamine; triethylamine.

According to preferred embodiment of the present invention, the process can employ a modified Caro's acid (as disclosed in Canadian patent application 3,128,678) comprises: sulfuric acid; a heterocyclic compound; and wherein sulfuric acid and said a heterocyclic compound; are present in a molar ratio of no less than 1:1. Preferably, the sulfuric acid and said heterocyclic compound are present in a molar ratio ranging from 28:1 to 2:1 More preferably, the sulfuric acid and heterocyclic compound are present in a molar ratio ranging from 24:1 to 3:1. Preferably, the sulfuric acid and heterocyclic compound are present in a molar ratio ranging from 20:1 to 4:1. More preferably, the sulfuric acid and heterocyclic compound are present in a molar ratio ranging from 16:1 to 5:1. Preferably, the sulfuric acid and heterocyclic compound are present in a molar ratio ranging from 12:1 to 6:1. Also preferably, said heterocyclic compound has a molecular weight below 300 g/mol. Also preferably, said heterocyclic compound has a molecular weight below 150 g/mol. More preferably, said heterocyclic compound is a secondary amine. According to a preferred embodiment of the present invention, said heterocyclic compound is selected from the group consisting of: imidazole; triazole; and N-methylimidazole.

According to preferred embodiment of the present invention, the process can employ a modified Caro's acid (as disclosed in Canadian patent application 3,128,676) comprises: sulfuric acid; a modifying agent comprising an alkanesulfonic acid; and wherein sulfuric acid and said alkanesulfonic acid are present in a molar ratio of no less than 1:1. Preferably, said alkanesulfonic acid is selected from the group consisting of: alkanesulfonic acids where the alkyl groups range from C1-C6 and are linear or branched; and combinations thereof. Preferably, said alkanesulfonic acid is selected from the group consisting of: methanesulfonic acid; ethanesulfonic acid; propanesulfonic acid; 2-propanesulfonic acid; isobutylsulfonic acid; t-butylsulfonic acid; butanesulfonic acid; iso-pentylsulfonic acid; t-pentylsulfonic acid; pentanesulfonic acid; t-butylhexanesulfonic acid; and combinations thereof. More preferably, said alkanesulfonic acid is methanesulfonic acid. Also preferably, said alkanesulfonic acid has a molecular weight below 300 g/mol. Also preferably, said alkanesulfonic acid has a molecular weight below 150 g/mol. Preferably, the sulfuric acid and said alkanesulfonic acid and are present in a molar ratio ranging from 28:1 to 2:1. More preferably, the sulfuric acid and alkanesulfonic acid are present in a molar ratio ranging from 24:1 to 3:1. Preferably, the sulfuric acid and alkanesulfonic acid are present in a molar ratio ranging from 20:1 to 4:1. More preferably, the sulfuric acid and alkanesulfonic acid are present in a molar ratio ranging from 16:1 to 5:1. According to a preferred embodiment of the present invention, the sulfuric acid and alkanesulfonic acid are present in a molar ratio ranging from 12:1 to 6:1.

According to preferred embodiment of the present invention, the process can employ a modified Caro's acid (as disclosed in Canadian patent application 3,128,675) comprises: sulfuric acid; a substituted aromatic compound; and wherein sulfuric acid and said substituted aromatic compound; are present in a molar ratio of no less than 1:1. Preferably, the substituted aromatic compound comprises at least two substituents. More preferably, at least one substituent is an amine group and at least one of the other substituent is a sulfonic acid moiety. According to a preferred embodiment, the substituted aromatic compound comprises three or more substituent. According to a preferred embodiment of the present invention, the substituted aromatic compound comprises at least a sulfonic acid moiety. According to another preferred embodiment of the present invention, the substituted aromatic compound comprises an aromatic compound having a sulfonamide substituent, where the compound can be selected from the group consisting of: benzenesulfonamides; toluenesulfonamides; substituted benzenesulfonamides; and substituted toluenesulfonamides. Preferably, the sulfuric acid and said substituted aromatic compound and are present in a molar ratio ranging from 28:1 to 2:1. More preferably, the sulfuric acid and substituted aromatic compound are present in a molar ratio ranging from 24:1 to 3:1. Preferably, the sulfuric acid and substituted aromatic compound are present in a molar ratio ranging from 20:1 to 4:1. More preferably, the sulfuric acid and substituted aromatic compound are present in a molar ratio ranging from 16:1 to 5:1. Preferably, the sulfuric acid and substituted aromatic compound are present in a molar ratio ranging from 12:1 to 6:1.

According to preferred embodiment of the present invention, the process can employ a modified Caro's acid (as disclosed in Canadian patent application 3,128,674) comprises: sulfuric acid; a modifying agent comprising an arylsulfonic acid; and optionally, a compound containing an amine group; wherein sulfuric acid and said a arylsulfonic acid; are present in a molar ratio of no less than 1:1. Preferably, the compound containing an amine group is selected from the group consisting of: imidazole; N-methylimidazole; triazole; monoethanolamine (MEOA); diethanolamine (DEOA); triethanolamine (TEOA); pyrrolidine and combinations thereof. According to a preferred embodiment of the present invention, sulfuric acid and the peroxide are present in a molar ratio of approximately 1:1. Preferably, the sulfuric acid and said arylsulfonic acid and are present in a molar ratio ranging from 28:1 to 2:1. More preferably, the sulfuric acid and arylsulfonic acid are present in a molar ratio ranging from 24:1 to 3:1. Preferably, the sulfuric acid and arylsulfonic acid are present in a molar ratio ranging from 20:1 to 4:1. More preferably, the sulfuric acid and arylsulfonic acid are present in a molar ratio ranging from 16:1 to 5:1. According to a preferred embodiment of the present invention, the sulfuric acid and arylsulfonic acid are present in a molar ratio ranging from 12:1 to 6:1. Also preferably, said arylsulfonic acid has a molecular weight below 300 g/mol. Also preferably, said arylsulfonic acid has a molecular weight below 150 g/mol. Even more preferably, said arylsulfonic acid is selected from the group consisting of: orthanilic acid; metanilic acid; sulfanilic acid; toluenesulfonic acid; benzenesulfonic acid; and combinations thereof.

According to preferred embodiment of the present invention, the process can employ a modified Caro's acid (as disclosed in Canadian patent application 3,128,673) comprises: sulfuric acid; a heterocyclic compound; an alkanesulfonic acid; and wherein sulfuric acid and said a heterocyclic compound; are present in a molar ratio of no less than 1:1. Preferably, said aqueous acidic composition comprising: sulfuric acid; a heterocyclic compound; an arylsulfonic acid; and wherein sulfuric acid and said a heterocyclic compound; are present in a molar ratio of no less than 1:1. Preferably, the arylsulfonic acid is toluenesulfonic acid.

Preferably, the sulfuric acid, the heterocyclic compound and the alkanesulfonic acid are present in a molar ratio ranging from 28:1:1 to 2:1:1. More preferably, the sulfuric acid the heterocyclic compound and the alkanesulfonic acid are present in a molar ratio ranging from 24:1:1 to 3:1:1. Preferably, the sulfuric acid, the heterocyclic compound and the alkanesulfonic acid are present in a molar ratio ranging from 20:1:1 to 4:1:1. More preferably, the sulfuric acid, the heterocyclic compound and the alkanesulfonic acid are present in a molar ratio ranging from 16:1:1 to 5:1:1. According to a preferred embodiment of the present invention, the sulfuric acid and heterocyclic compound are present in a molar ratio ranging from 12:1:1 to 6:1:1. Also preferably, said heterocyclic compound has a molecular weight below 300 g/mol. Also preferably, said heterocyclic compound has a molecular weight below 150 g/mol. Even more preferably, said heterocyclic compound is selected from the group consisting of: imidazole; triazole; n-methylimidazole; and combinations thereof. Preferably, the alkanesulfonic acid is selected from the group consisting of: alkylsulfonic acids where the alkyl groups range from C1-C6 and are linear or branched; and combinations thereof. Preferably, said alkylsulfonic acid is selected from the group consisting of: methanesulfonic acid; ethanesulfonic acid; propanesulfonic acid; 2-propanesulfonic acid; isobutylsulfonic acid; t-butylsulfonic acid; butanesulfonic acid; iso-pentylsulfonic acid; t-pentylsulfonic acid; pentanesulfonic acid; t-butylhexanesulfonic acid; and combinations thereof. More preferably, said alkylsulfonic acid is methanesulfonic acid.

According to preferred embodiment of the present invention, the process can employ a modified Caro's acid (as disclosed in Canadian patent application 3,128,672) comprises: sulfuric acid; a carbonyl-containing nitrogenous base compound; and wherein sulfuric acid and said a carbonyl-containing nitrogenous base compound; are present in a molar ratio of no less than 1:1. According to a preferred embodiment of the present invention, the carbonyl-containing nitrogenous base compound is selected from the group consisting of: caffeine; lysine; creatine; glutamine; creatinine; 4-aminobenzoic acid; glycine; NMP (N-methyl-2-pyrrolidinone); histidine; DMA (N,N-dimethylacetamide); arginine; 2,3-pyridinedicarboxylic acid; hydantoin; and combinations thereof. Preferably, the sulfuric acid and said carbonyl-containing nitrogenous base compound and are present in a molar ratio ranging from 28:1 to 2:1. More preferably, the sulfuric acid and carbonyl-containing nitrogenous base compound are present in a molar ratio ranging from 24:1 to 3:1. Preferably, the sulfuric acid and carbonyl-containing nitrogenous base compound are present in a molar ratio ranging from 20:1 to 4:1. More preferably, the sulfuric acid and carbonyl-containing nitrogenous base compound are present in a molar ratio ranging from 16:1 to 5:1. According to a preferred embodiment of the present invention, the sulfuric acid and carbonyl-containing nitrogenous base compound are present in a molar ratio ranging from 12:1 to 6:1.

Emergency Reaction Temperature Control

Preferably, according to an embodiment where water addition into the vessel is avoided to the greatest extent possible, the control of the delignification reaction is done by controlling the temperature of the mixture within the vessel through the use of external or internal heat exchangers and therefore, the exothermicity of the delignification, the reaction is controlled by slowly adding the biomass into the vessel containing the sulfuric acid component and the peroxide component and allowing the reaction to occur before the addition of more biomass material. Once the reaction of the first amount of biomass has substantially finished more biomass material is added, this additional material will react and will begin to delignify but the reaction will be tempered to a certain extent by the presence of the prior delignified material and thus, cause the second amount of biomass to react in a more diluted mixture and so on, for subsequent additions of biomass into the vessel. According to a preferred embodiment of the present invention, the temperature increase resulting from the delignification reaction (which is exothermic) is utilized to heat the reaction mixture to the desired 30-45° C. range. This coincides with the advanced temperature control system, which allows for self-sufficient heat generation.

According to an aspect of the present invention, there is provided a process to perform a controlled exothermic delignification of biomass, said process consisting of:

- providing a vessel;
- providing biomass comprising lignin, hemicellulose, and cellulose fibers into the said vessel;
- providing an aqueous acidic composition comprising a sulfuric acid component;
- providing a peroxide component;
- providing a modifier component;
- exposing said biomass to said sulfuric acid source, said peroxide component and said modifier component to create a reaction mass;
- allowing said sulfuric acid source, said peroxide component and said modifier component to come into contact with said biomass for a while sufficient for a delignification reaction to occur and remove over 90 wt % of said lignin and hemicellulose from said biomass.

Continuous Digester

According to an aspect of the present invention, there is provided a continuous digester adapted for use in the delignification of lignocellulosic biomass with a modified Caro's acid composition, where said continuous digester comprises:

- a cylindrical vessel comprising a first extremity and a said extremity; wherein the biomass loaded therein can have size distributions between 1 mm to 75 mm;
- design parameters of the vessel comprise:
  - diameter to length ratio of vessel. Preferably, the diameter to length ratio ranges from 0.08:1 to 0.2:1
  - an inlet, located at said first extremity, for loading said digester with said biomass component and said modified Caro's acid thus creating a reaction mixture;
  - at least two zones for mixing a reaction mixture comprising said modified Caro's acid and said biomass component; said at least two zones being positioned sequentially within said cylindrical vessel;
  - each one of said at least two zones comprising:
    - a temperature indicator/controller to monitor changes in a pre-determined temperature set point, to control heat exchanger setpoint, jet nozzles flow;
    - a jet nozzle, located at a top section of said zone, to provide pumping mixing of the reaction mixture comprising said biomass component and said modified Caro's acid;
    - an extraction screen, located proximate at a bottom section of said zone, to allow the extraction of said modified Caro's acid from the bottom section of said zone;
    - a screen section on the vertical plane having perforations of the a shape selected from the group consisting of: circle, rectangular, square etc. and where screen size openings ranging from ⅛" to 6";
    - a piping connected to said extraction screen and said jet nozzle to allow for recirculation of said modified Caro's acid from the bottom section of the zone to said top section of said zone;
    - a chiller and heater feed loop, located outside of said zone, to allow for chilling/heating the modified Caro's acid solution to desired parameters;
    - a Kappa number analyzer to allow the determination of the pulping percentage of the biomass;
    - a peroxide analyzer to allow the determination of the peroxide consumption; and
  - a cone bottom adapted with an outlet, located at said second extremity, for discharging of the reaction mass.

Preferably, the screens are located at the entrance of the discharge piping. Ideally the screens would be of differing sizes from the first section and the subsequent sections given the size and physical properties of the biomass changes as the biomass travels down the subsequent sections when it is pulped. Moreover, to prevent clogging of the screens the pump can reverse the flow of the fluid so as to dislodge the material accumulate on the screens.

An important feature of the process and of the digester according to a preferred embodiment of the present invention, is the recirculation which is controlled inside the digester and the gravitational flow in the liquid which maintains the biomass within each section which serves to promote the delignification of the biomass. Given the vessel operates under a gauge pressure of 14 psi and 60° C., the physical biomass inside the vessel pulps gradually down the subsequent sections, its physical properties change unlike a kraft digester where the biomass shape is retained due to high pressure until it is discharged into a blow tank.

Another feature of the process that differs from a kraft digester is that there exists no impregnation, cooking and washing zone in the vessel.

Preferably, said digester is positioned vertically with the inlet being located a top portion thereof and the outlet located at a bottom portion of said digester.

BRIEF DESCRIPTION OF THE FIGURES

Features and advantages of embodiments of the present application will become apparent from the following detailed description and the appended figures, in which.

DETAILED DESCRIPTION

According to a preferred embodiment of the present invention, there is provided a process to perform a controlled exothermic delignification of biomass, said process comprising the steps of:

- providing a system comprising at least a first vessel and a second vessel;
- providing biomass comprising lignin, hemicellulose and cellulose fibers into said first vessel;
- providing a aqueous acidic composition comprising a sulfuric acid component;
- providing a peroxide component;
- exposing said biomass to said sulfuric acid component and peroxide component, creating a reaction mass (or mixture);

mixing said reaction mass;

allowing said sulfuric acid component and peroxide component to come into contact with said biomass for a period of time sufficient to a delignification reaction to occur and remove a pre-determined amount of said lignin from said biomass;

wherein said pre-determined amount is assessed by testing a first remaining peroxide concentration, with a suitable apparatus, in the reaction mixture, when said first remaining peroxide concentration is reached, the biomass is transferred to said second vessel;

allowing the temperature of the biomass mixture to increase during the residence time of said biomass in said second vessel;

allowing said sulfuric acid component and peroxide component to continue said delignification reaction at said second temperature and remove a second pre-determined amount of said lignin from said biomass;

wherein said second pre-determined amount is assessed by determining a second remaining peroxide concentration, with a suitable apparatus, in the reaction mixture, when said second remaining peroxide concentration is reached, the biomass is removed from said second vessel;

optionally, a washing step is employed to separate the liquid portion containing said lignin and hemicellulose from the solid portion containing the cellulose extracted from the biomass.

Figure 1:
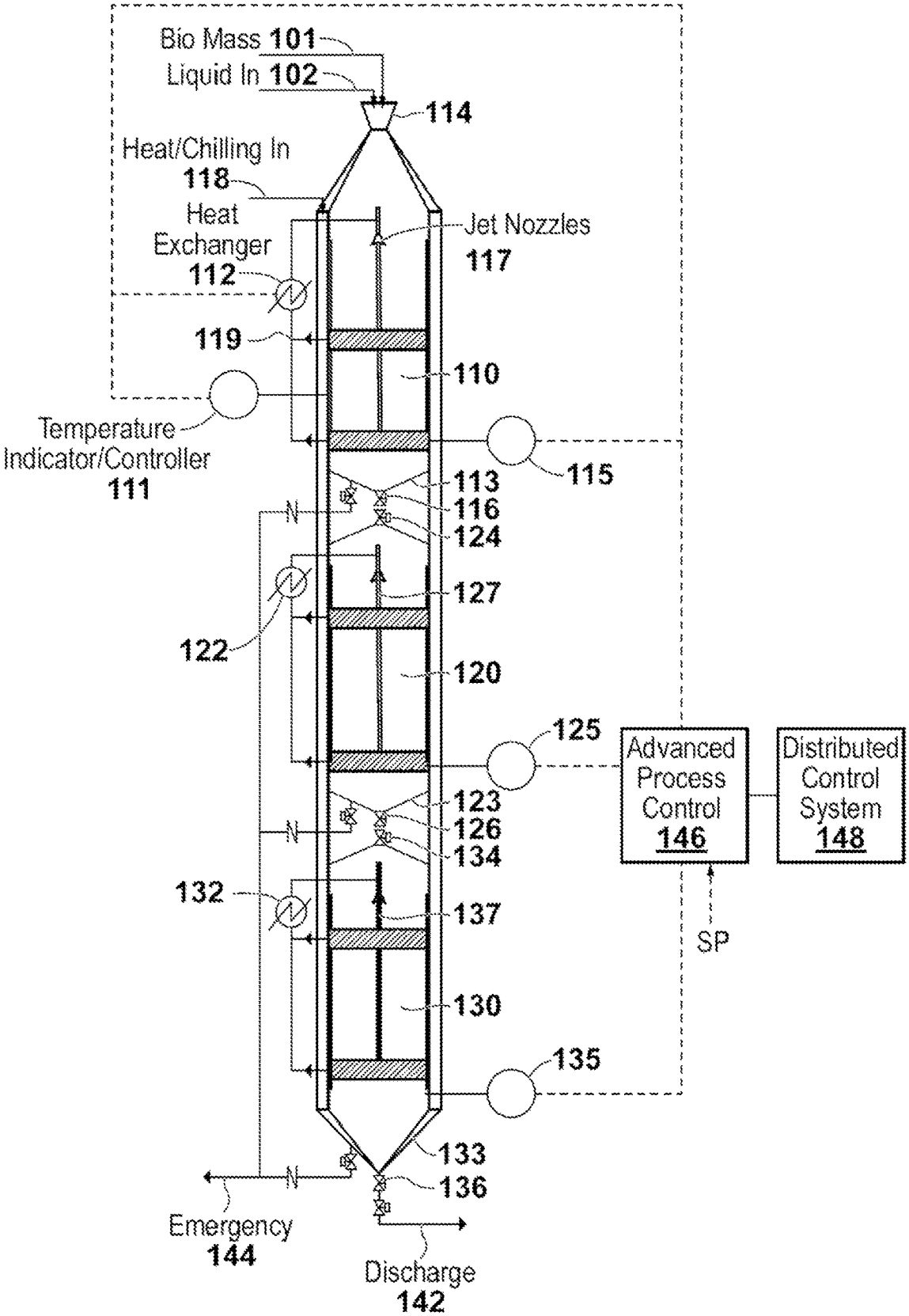
FIG. 1 illustrates a system capable of implementing the process according to a preferred embodiment of the present invention.

The process mentioned hereinabove can be accomplished by using a system as illustrated in FIG. 1. Said system according to a preferred embodiment of the present invention comprises a first vessel (110) operating at a first temperature, where said biomass (101) is added and subsequently mixed with a delignification composition (102) having an initial peroxide concentration for a pre-determined period of time or until the reaction mixture reaches a pre-determined first remaining peroxide concentration which is measured through the use of a sampling point (115). Preferably, once the reaction mixture reaches a pre-determined first remaining peroxide concentration the it is then transferred to a second vessel (120) where the delignification reaction occurs at a second temperature which can be set higher than said first temperature. Said reaction mixture having said first remaining peroxide concentration continues to be mixed with said delignification composition for a pre-determined period of time or until the reaction mixture reaches a pre-determined second remaining peroxide concentration which is measured through the use of a sampling point (125) associated with said second vessel (120). Preferably, once the biomass reaches said pre-determined second remaining peroxide concentration the reaction mixture is then transferred to a third vessel where the delignification reaction occurs at a third temperature which can be set higher than said second temperature. Said reaction mixture having said second remaining peroxide concentration continues to be mixed with said delignification composition for a pre-determined period of time or until the reaction mixture reaches a third remaining peroxide concentration which is measured through the use of a sampling point (135) associated with said third vessel (130). Preferably, once the biomass reaches said pre-determined fourth kappa number, the reaction mixture is then discharged and the solid portion is separated from the liquid portion and the liquid is recovered and re-inserted into the process by injecting it into the first vessel.

The system comprises a temperature Indicator/Controller (111) which is designed to monitor changes in temperature set point, to control Heat Exchanger (112) setpoint, jet nozzles (117). The jet nozzles (117) on the center main piping system are designed to provide pumping mixing of the reaction mixture comprising the biomass feedstock and delignification composition (chemical solution).

According to a preferred embodiment of the present invention, the system further comprises an extraction screen for the liquid chemical solution which is designed to extract chemical solution from the vessel to pump into the jet nozzle.

As seen in FIG. 1, the system comprises a heat/cooling jacket (118) which is designed to be a secondary temperature control method for chilling/heating. This can prove to be useful since the delignification reaction is exothermic and control of the temperature is desirable in order to ensure that the yield is maximized.

FIG. 1 additionally shows a top inlet valve (114), a heat exchanger loop (122) associated with second vessel (120), a heat exchanger loop (132) associated with third vessel (130), a valve (134), a discharge (142), and an emergency line (144).

At the bottom of each of the vessels (110, 120, 130) is located an actuated discharge valve (116, 126 and 136 respectively) which is designed to discharge product slurry (biomass and delignification composition) into next stage.

The advanced process controls (146) (APC) tool is generally used for individual processes and connects to the and distributed control system (148) (DCS) which is generally in control of the entire process facility. APC is the developed system of integrating multi factors including DCS. The system components virtually communicate with each other and adjust parameters according the programmed inputs. It utilizes real time optimization, reading process variables and continuously adjust for the target rage it is programmed for.

According to the preferred embodiment illustrated, the system also comprises a chiller & heater feed loop (119) which is designed to be the primary method to chill/heat solution to desired parameters.

In the embodiment illustrated in FIG. 1, the system further comprises a central main piping system which is a piping system equipped with jet nozzles (117) designed to distribute the chemical solution to biomass. The system further comprises a peroxide concentration testing points (115, 125, and 135, respectively) at each stage to determine the pulping percentage.

According to a preferred embodiment of the present invention, the system further comprises at least one tank baffle which is designed to increase mixing efficiency. Each of the vessels (110, 120, 130) in the system further comprises a cone bottom (113, 123, 133, respectively) which is desirable for easier reaction mixture discharge from one vessel to the next vessel.

According to a preferred embodiment of the present invention, the system further comprises a top mount agitator (127, 137) which is designed to provide the desired agitation to the reaction mixture in the said second vessel (120) and third vessel (130). In some cases, the mixing in the first vessel (110) is done by a paddle mixer in other cases it may be done by recirculation of the reaction mixture through a pump and jet nozzle. In other cases, there can be a combination of mixing effected by a paddle stirrer and pumping mixture recirculation.

According to a preferred embodiment of the present invention, the system further comprises a top mount agitator (127, 137) which is designed to provide the desired agitation to the reaction mixture in the said second vessel (120) and third vessel (130). Mixing in the first vessel (110) is done by recirculation of the reaction mixture through a pump and jet nozzle.

According to a preferred embodiment of the present invention, the process comprises a step of blending where the liquid containing a proprietary blend is routed to the reactor vessel. Subsequently, the mixer agitates the blend in the reactor during chemical addition, biomass addition, and reaction. To increase mixing, the circulation pump is used to circulate material from the mesh back to the top. The biomass is added to the reactor through the top entry port.

The delignification reaction takes place and creates an exothermic environment within the reaction vessel. The level & temperature in the reactor is monitored. When the first stage of the reaction is completed (based on the determined remaining peroxide concentration), an actuated valve is opened, and the reaction mixture is moved to the second vessel to being the second stage of the delignification process. The process is repeated for stages 2 & 3 (i.e. when there is a second and a third vessel).

Preferably, the heating of the mixture is carried out by using a glycol-water mixture heated by a boiler. The heat exchanger fluid travels through the reactor (vessel) heat exchanger & tank jacket, bypassing the chiller, to heat the reaction mixture to the desired reaction starting temperature. During biomass addition and reaction, the glycol water mixture is cooled by the chiller. The heat exchanger fluid travels through the external reactor heat exchanger & cooling jacket to maintain the desired reaction temperature.

According to a preferred embodiment of the present invention, the system further comprises an emergency shutdown procedure where if the reaction temperature increases above a certain set temperature, for example in some cases it may be set at 50° C., a control valve opens and the reactor is flooded with water thereby stopping the reaction. When such a shutdown occurs, the contents of the reactor are rerouted to the overflow tank via the circulation pump.

According to a preferred embodiment of the present invention, the system is set up to have the initial reaction temperature of the process be in the range of 20-30° C. and increase as the reaction progresses. The temperature transmitter submerged in the reactor sends this value to the temperature control system. As the temperature increases to 50° C., the Temperature Controller sends a signal to the control valve on the water outlet line to open by 25%. According to a preferred embodiment of the present invention, the system will, with every 1° C. increase registered by the Temperature Transmitter starting at 50° C., send a signal to the control valve to open by 25% more until fully opens at 53° C., stopping the reaction completely. Preferably, the temperature control is performed by using jet nozzle sprays which can spray uniformly the surface of the chemical-biomass mixture. The water sprayed is then mixed in with the mixture in the presence of agitators or by re-circulation of the reaction mixture (i.e. without a conventional agitator).

Figure 2:
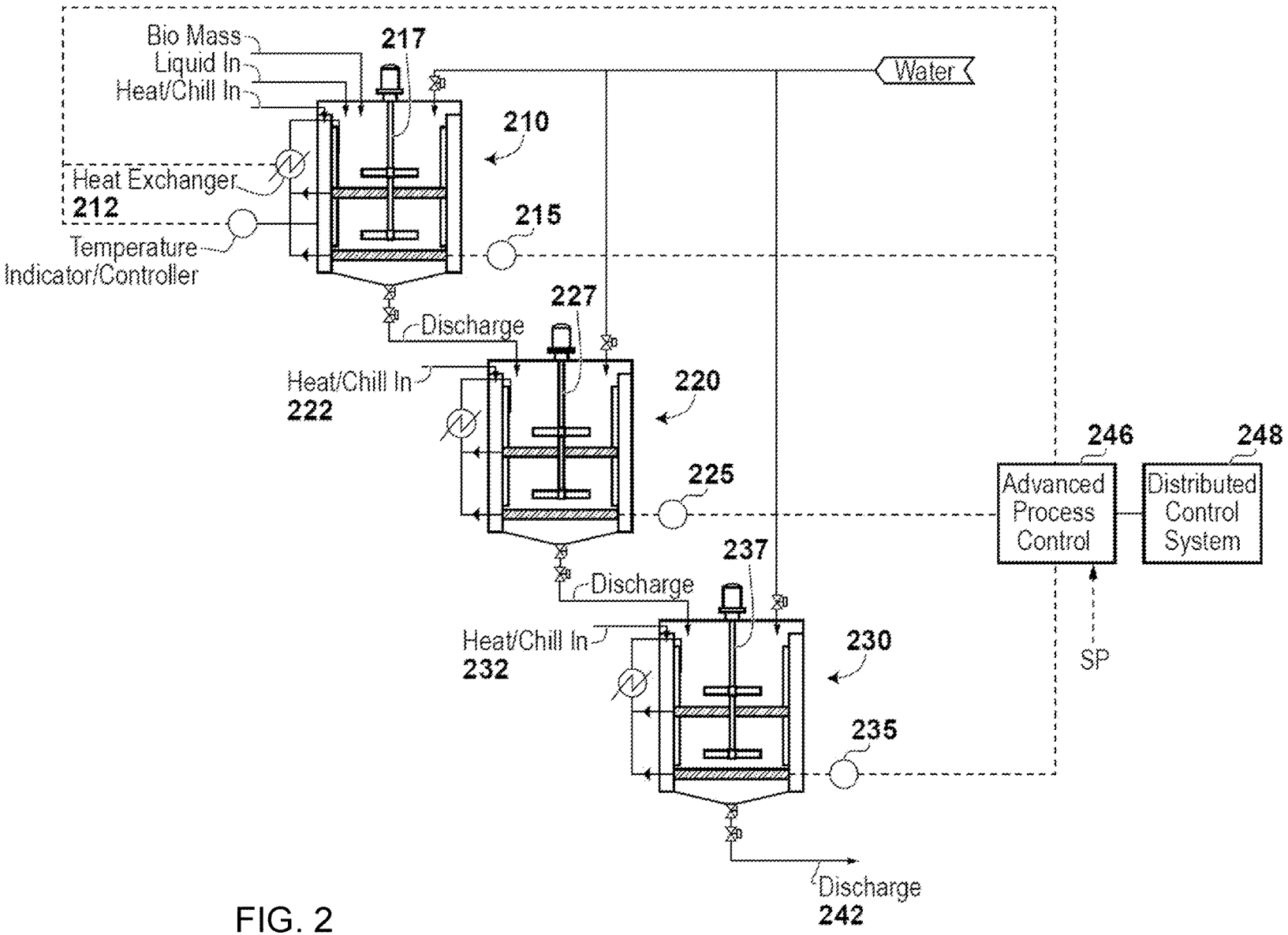
FIG. 2 shows a scaled-up system capable of performing the process according to a preferred embodiment of the present invention.

As illustrated in FIG. 2, a system according to a preferred embodiment of the present invention comprises a first vessel (210) operating at a first temperature, where said biomass (201) and a delignification composition (202) (having an initial peroxide concentration) are combined to produce a reaction mixture. The reaction mixture is mixed for a pre-determined period of time or until the reaction mixture reaches a first remaining peroxide concentration in the reaction mass. Said first remaining peroxide concentration in the reaction mass being determined by removing a portion of the delignification composition and testing for the peroxide concentration at a testing point (215). Preferably, once the biomass reaches a pre-determined first remaining peroxide concentration in the reaction mass the reaction mixture is then transferred to a second vessel (220) where the delignification reaction occurs at a second temperature which can be set higher than said first temperature. Said biomass having said first remaining peroxide concentration in the reaction mass continues to be mixed with said delignification composition for a pre-determined period of time or until the biomass reaches a pre-determined a second remaining peroxide concentration in the reaction mass. Said second remaining peroxide concentration in the reaction mass being determined by removing a portion of the delignification composition and testing for the peroxide concentration at a testing point (225) associated with said second vessel (220). Preferably, once the reaction mixture reaches said pre-determined second remaining peroxide concentration, the reaction mixture is then transferred to a third vessel where the delignification reaction occurs at a third temperature which can be set higher than said second temperature. Said reaction mixture having said second remaining peroxide concentration in the reaction mass continues to be mixed with said delignification composition for a pre-determined period of time or until the biomass reaches a pre-determined third remaining peroxide concentration in the reaction mass. Said third remaining peroxide concentration in the reaction mass being determined by removing a portion of the delignification composition and testing for the peroxide concentration at a testing point (235) associated with said third vessel (230). Preferably, once the reaction mixture reaches said pre-determined third remaining peroxide concentration, the reaction mixture is then discharged through the discharge (242) and the solid portion is separated from the liquid portion and the liquid is recovered and re-inserted into the process by injecting it into the first vessel. The cellulose comprising the solid portion is subjected to other post-delignification treatment steps depending on the ultimate use thereof.

As seen in FIG. 2, each vessel (210, 220, 230) comprises their own paddle stirrer (217, 227, 237, respectively), heat exchanger (212, 222, 232 respectively), composition sampling or testing points (215, 225, 235, respectively) while the system operates with an advanced process control (246) and a distributed control system (248). According to a preferred embodiment of the present invention, there are no internal baffles in the digester.

Preferably, the third remaining peroxide concentration in the reaction mass is near zero as the presence of peroxide at the point of discharge of the delignified biomass is undesirable for further treatment of the liquid discharge. Moreover, unreacted peroxide at the point of discharge is considered to be waste. Since the peroxide is the main consumed reactant during the delignification of lignocellulosic biomass it is desirable to optimize the reaction parameter to make use of it.

Biomass Loading

According to a preferred embodiment of the present invention, the biomass loading in the vessel for the delignification reaction can go up to 20 wt. %. According to a preferred embodiment of the present invention, the biomass loading in the vessel for the delignification reaction can go up to 15 wt. %. According to a preferred embodiment of the present invention, the biomass loading in the vessel for the delignification reaction can go up to 10 wt. %. Preferably, the biomass loading in the vessel for the delignification reaction can go up to 8 wt. %. More preferably, the biomass loading in the vessel for the delignification reaction can go up to 7 wt. %. According to a preferred embodiment of the present invention, the biomass loading in the vessel for the delignification reaction ranges from 4 to 6 wt. %.

Temperature

According to a preferred embodiment of the present invention, the initial temperature in the vessel where the delignification occurs can be as low as 25° C. and still provide substantial delignification within a reasonable period of time. Preferably, the initial temperature in the vessel where the delignification occurs is 27° C. More preferably, the initial temperature in the vessel where the delignification occurs is 30° C. According to a preferred embodiment of the present invention, the initial temperature in the vessel where the delignification occurs ranges from 30 to 45° C. According to a preferred embodiment of the present invention, the initial temperature in the vessel where the delignification occurs ranges from 32 to 40° C.

Time

According to a preferred embodiment of the present invention, the duration of the delignification reaction can last up to 24 hours. Preferably, the duration of the delignification reaction can last up to 12 hours. Preferably, the duration of the delignification reaction can last up to 6 hours. Preferably, the duration of the delignification reaction can last up to 4 hours. According to a preferred embodiment of the present invention, the duration of the delignification reaction takes about 3 hours. In some preferred embodiments, the duration of the delignification reaction may take as little as 1.5 hours.

According to a preferred embodiment of the present invention, the chemicals used in a delignification reaction may be reused in a subsequent delignification and still maintain good delignification power. According to a preferred embodiment of the present invention, the chemicals used in a delignification reaction may be reused in a subsequent delignification by adding some of the peroxide component (referred to as "topping up") and still maintain good delignification power. The recycling of the chemicals used in the delignification provides several advantages with one of the most obvious one being eliminating the discharge of spent (or used) chemicals). According to a preferred embodiment of the present invention, the chemicals used in a delignification reaction may be reused several times by topping up with peroxide between each reaction.

According to a preferred embodiment of the present invention when employing a batch method to delignify biomass, a valuable approach to optimize the hydrogen peroxide ($H_2O_2$) consumption is the recycling of the reaction blend after each reaction and removal of the solid cellulose by solid liquid separation methods. This is performed and is highly advantageous to do so since only 20% of the hydrogen peroxide ($H_2O_2$) added to the blend is consumed. Hence, in such an instance, recycling the acid blend (modified Caro's acid), having a high quantity of unreacted peroxide component after the separation of the resulting cellulose substantially reduces the overall peroxide ($H_2O_2$) consumption.

According to a preferred embodiment of the present invention, good control of the reaction temperature is one of the factors in driving the delignification reaction forward which indicates that the reaction is kinetically driven. Other experiments demonstrate that a delignification reaction time of 3 hours is achieved. Those experiments carried out in a temperature ranging from 30 to 45° C. show that the desired delignification is achieved without impacting the hydrogen peroxide ($H_2O_2$) consumption and the resulting cellulose's kappa number.

Figure 3:
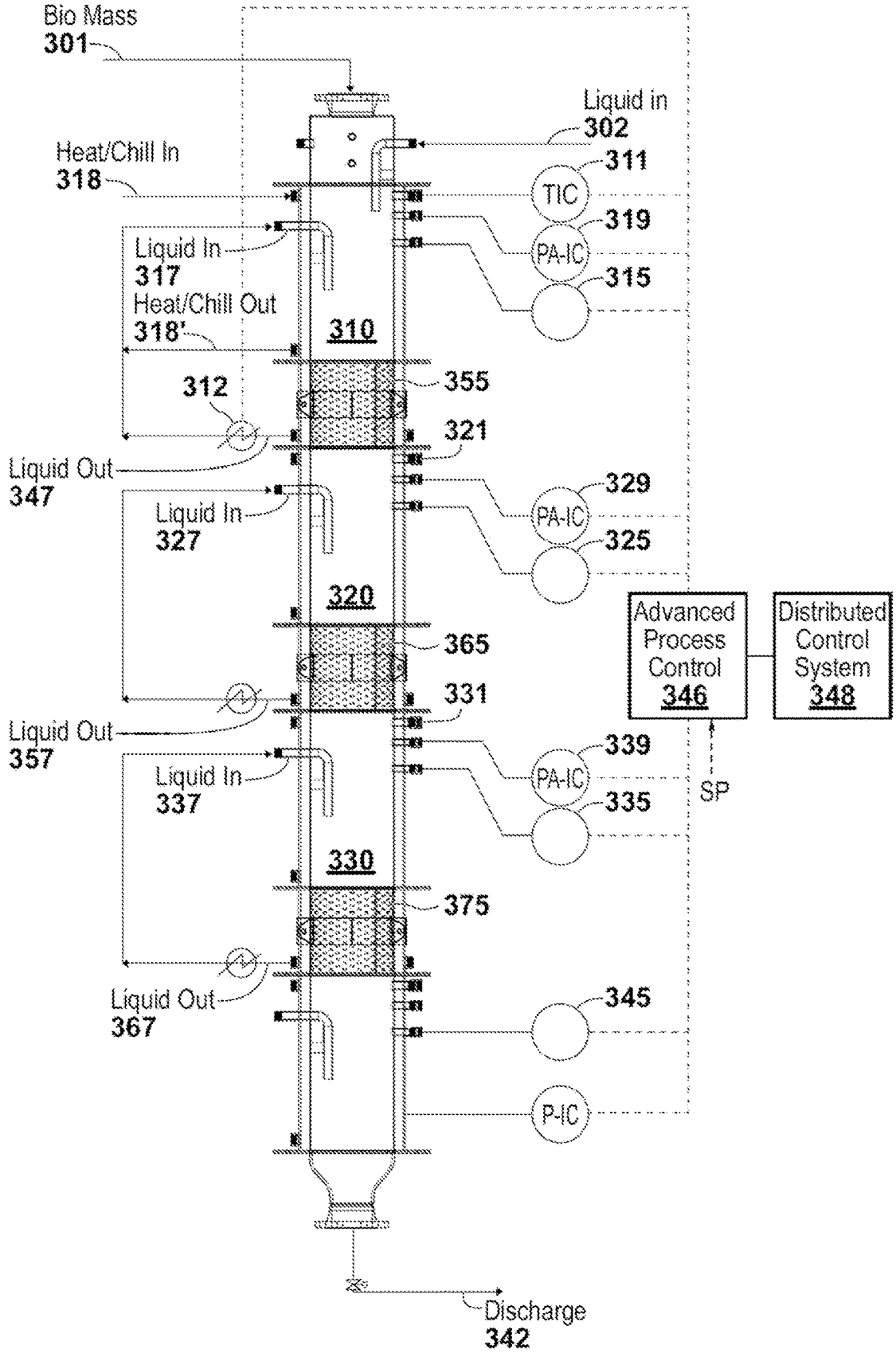
FIG. 3 shows a continuous digester capable of performing the process according to a preferred embodiment of the present invention.

As illustrated in FIG. 3, a continuous digester system according to a preferred embodiment of the present invention comprises a vessel divided into distinct zones (310, 320 and 330). Said first zone (310) operating at a first temperature, where said biomass (301) is continuously added at wt % loading of 3-6 wt %, or 7-10 wt %, or 10-15 wt % relative to liquid volume in the digester and a delignification composition (302) (having an initial peroxide concentration (ranging from 5 to 15%)) are combined to produce a reaction mixture. The reaction mixture is mixed using an internal close loop system by pumping liquid from screen (355) to input nozzle (315) for a pre-determined period of time to reach a residence time of 1-4 hrs or until the reaction mixture reaches a first remaining peroxide concentration in the reaction mass. Said first remaining peroxide concentration in the reaction mass being determined by performing an inline testing for the peroxide concentration at a testing point (319). Preferably, once the reaction mixture reaches a pre-determined first remaining peroxide concentration, the biomass slurry is then moved on to a second zone (320) by controlling the flow rates of the internal circulation in distinct zones where the delignification reaction occurs at a second temperature which can be set higher than said first temperature. Said reaction mixture having said first remaining peroxide concentration continues to be mixed with said delignification composition for a pre-determined period of time or until the reaction mixture reaches a pre-determined a second remaining peroxide concentration. Said second remaining peroxide concentration in the reaction mixture being determined by by performing an inline testing for the peroxide concentration at a testing point (329) associated with said second zone (320). Preferably, once the reaction mixture reaches said pre-determined second remaining peroxide concentration, the reaction mixture is then moved on to a third zone (330) where the delignification reaction occurs at a third temperature which can be set higher than said second temperature. Said reaction mixture having said second remaining peroxide concentration continues to be mixed with said delignification composition for a pre-determined period of time or until the reaction mixture reaches a pre-determined third remaining peroxide concentration. Said third remaining peroxide concentration in the reaction mixture being determined by performing an inline testing for the peroxide concentration at a testing point (339) associated with said third zone (330). Preferably, once the reaction mixture reaches said pre-determined third remaining peroxide concentration, the reaction mixture is then discharged through the discharge (342) of the digester and the solid portion is separated from the liquid portion and the liquid is recovered and re-inserted into the process by injecting it back into the digester. The cellulose comprising the solid portion is subjected to other post-delignification treatment steps depending on the ultimate use thereof.

As seen in FIG. 3, each zone (310, 320, 330) comprises their own mixing through the use of jet nozzles (317, 327, 337, respectively), as well as heat exchanger (318, 318') represent the tubing for the circulation of the heating/cooling liquid for the first zone), composition sampling or testing points (315, 325, 335, respectively) while the system operates with an advanced process control (346) and a distributed control system (348). Further, each zone comprises an extraction screen (355, 365, 375 respectively) to allow for the removal of a portion of the liquid chemical solution from the zone to pump back into their respective zone and as such provide mixing within the zone as well as to heat or cool the solution.

FIG. 3 additionally shows a temperature indicator/controller (311), a pump (312), a connection/port feature (331), an instrument/controller (345), a liquid outlet (347) associated with the first zone (310), a liquid outlet (357) associated with the second zone (320), and a liquid outlet (367) associated with the third zone (330).

Batch Experiments

A series of experiments carrying out delignification using a modified Caro's acid were carried out to evaluate the feasibility of recycling the reacted modified Caro's acid composition for continuous batch processing. This was studied to evaluate the behavior of the peroxide component in terms of efficiency in delignification and in order to determine how often it can be recycled in a batch process.

It was hypothesized that, under controlled conditions, continuous batch processing could be used to approximate a similar approach applied to continuous digestion (or delignification) of lignocellulosic biomass.

Accordingly, several batches of lignocellulosic biomass were delignified using a modified Caro's acid having the following characteristics as listed in Table 1.

TABLE 1

Composition of the modified Caro's acid used in the batch experiments

| Component | Molar Ratio | Mass % |
|---|---|---|
| H2O | 56 | 38.53 |
| H2O2 | 10 | 14.46 |
| H2SO4 | 10 | 41.69 |
| Taurine | 1 | 5.32 |

A first batch of biomass was mixed with the above-mentioned modified Caro's acid kept at a temperature ranging from 32 to 37° C. for a duration of 20 hours. The initial peroxide concentration was determined to be 14.03%. The remaining peroxide concentration measured after the reaction was completed was determined to be 11.32%. The kappa number of the resulting cellulose at the end of the reaction was measured and determined to be below 5.

The resulting modified Caro's acid, where the content of peroxide determined to be 11.32%, was mixed with a second batch of biomass to provide a second treatment batch. The second treatment batch was kept at a temperature ranging from 32 to 37° C. for a duration of 20 hours. The remaining peroxide concentration measured after the reaction was completed was determined to be 8.44%. The kappa number of the resulting cellulose at the end of the reaction was measured and determined to be below 5.

The resulting modified Caro's acid, where the content of peroxide determined to be 8.44%, was mixed with a third batch of biomass to provide a third treatment batch. The third treatment batch was kept at a temperature ranging from 32 to 37° C. for a duration of 20 hours. The remaining peroxide concentration measured after the reaction was completed was determined to be 5.94%. The kappa number of the resulting cellulose at the end of the reaction was measured and determined to be below 5.

The resulting modified Caro's acid, where the content of peroxide determined to be 5.94%, was mixed with a fourth batch of biomass to provide a second treatment batch. The fourth treatment batch was kept at a temperature ranging from 32 to 37° C. for a duration of 20 hours. The remaining peroxide concentration measured after the reaction was completed was determined to be 3.83%. The kappa number of the resulting cellulose at the end of the reaction was measured and determined to be below 5.

The resulting modified Caro's acid, where the content of peroxide determined to be 3.83%, was mixed with a fifth batch of biomass to provide a second treatment batch. The fifth treatment batch was kept at a temperature ranging from 32 to 37° C. for a duration of 20 hours. The remaining peroxide concentration measured after the reaction was completed was determined to be 2.34%. The kappa number of the resulting cellulose at the end of the reaction was measured and determined to be below 5.

In order to use up the remaining peroxide in the modified Caro's acid composition resulting from the fifth delignification reaction, it has been determined that in the above experiments, the modified Caro's acid could be reused for at least another biomass delignification treatment.

On the basis of the above batch experiments, it has been determined that continuous batch treatments could be carried out to optimize delignification efficiency has well as residence time of biomass through various steps.

Continuous Experiments

The objective of the first experiment was to validate that a peroxide gradient exists between the digester zones. In this experiment, biomass was continuously added at 15 min to 1 hr interval into zone 320 till 6% loading was obtained and was mixed with table 2.1 above-mentioned modified Caro's acid kept at a temperature ranging from 25 to 35° C. for a duration of 60 hours (in a continuous mode for each batch addition lasting approximately 12 hours). The residence time was controlled through the flow of liquid from screen The initial peroxide concentration was determined to be 5% in section 320. As biomass was intermittently added (at 15 minute intervals), the peroxide concentration in zone 320 measured 3.8%, 3.7%, 3.2%, 2.8%, 1.7% at 12 hr intervals while in zone 330 the peroxide concentration remained relatively unchanged ranging between 4.6-5%, confirming that a peroxide gradient does exist. The kappa number of the resulting cellulose from the bottom discharge at 12 hr intervals was determined to be below 2.

TABLE 2.1

Composition of the modified Caro's acid used in the contious expirements

| Component | Molar Ratio | Mass % |
|---|---|---|
| H2O | 18 | 45.98 |
| H2O2 | 10 | 12.71 |
| H2SO4 | 10 | 36.64 |
| Taurine | 1 | 4.68 |

TABLE 2.2

Composition of the modified Caro's acid used in the contious experiments

| Component | Molar Ratio | Mass % |
|---|---|---|
| H2O | 18 | 39.63 |
| H2O2 | 6 | 8.61 |
| H2SO4 | 10 | 41.40 |
| TEOA | 1 | 6.30 |
| MSA | 1 | 4.06 |

To further validate that a peroxide gradient is achieved through controlling internal mixing, biomass loading and residence time, experiments were repeated using a modified Caros's acid composition as set out in Table 2.2 modified Caros's acid. The peroxide concentration in zone 330 vs 320 had the following values (7.03%/4.12%), (6.00%/2.97%) and (6.95%/5.7%) each experiment having been separately performed.

The kappa number of the resulting cellulose from the bottom discharge at 12 hr intervals was determined to be below 2. This data indicates that the residence time of the biomass could be further shortened down to 8 hours and even more preferably, down to 4 hours.

An experiment was conducted using the modified Caros's acid composition set out in Table 2.1 to validate an overall decreasing peroxide can be obtained in the continuous digester.

Biomass was continuously added at 15 min to 1 hour intervals into zone 320 until 5% loading was achieved with a starting peroxide concentration of 5%. Zone circulation was performed to circulate in zone 330 using screen (375) resulting in the biomass travelling down the digester. Peroxide concentration was measured and determined to be 3.9% in zone B, and 3.7% in zone A, highlighting the presence of an overall peroxide gradient of 0.2%. Given the cellulose exiting zone 330 had a kappa number less than 2, this highlights the robustness and the reliability of the peroxide concentration measurements.

According to a preferred embodiment of the present invention, there is provided a new system and method conceived to modify the existing continuous digester used in energy-intensive delignification processes such as in the kraft process. Preferably, this continuous digester differs from existing pulp digesters as follows:

- the vessel is preferably made of stainless steel so as to withstand the modified Caro's acid which is used in the delignification process;
- the operating conditions are low, typically less than 14 gauge psi and 50° C.;
- monitoring of the extent of reaction output through a combination of peroxide analyzers and/or kappa number.

Preferably, the continuous digester utilizes the low energy intensive process of chemical impregnation of biomass with a chemical blend (preferably, a modified Caro's acid). According to a preferred embodiment of the present invention, the digester consists of a number of zones, each zone comprising a number of elements and providing a unique residence time for the reaction mixture determined by kappa analyzers and/or the peroxide concentration in the reaction mixture. Residence time is controlled through several factors such as biomass loading, biomass size, rate of circulation of each zone Careful monitoring of either one or both of those features ensures that the delignification reaction is carried out until the desired product is achieved. Preferably, this is meant to be understood that the kappa number of the resulting cellulose will be less than 10, more preferably, the kappa number will be less than 5, even more preferably, the kappa number will be less than 3, and yet even more preferably, the kappa number will be less than 2. According to a preferred embodiment, the remaining peroxide concentration in the final output from the continuous digester will be less than 4%, more preferably less than 3%, even more preferably less than 2% and yet even more preferably less than 1%.

According to a preferred embodiment of the present invention, the continuous digester delignifies the input biomass feedstock in a continuous process reactor. Preferably, the presence of a temperature Indicator/Controller allows operators to monitor changes in temperature set point, to control heat exchanger setpoint, jet nozzles flow. Preferably, the presence of jet nozzles on each zone provides pumping mixing of the biomass and chemical solution. Preferably, the presence of extraction screen for the liquid chemical solution allows the extraction of the chemical solution from the vessel to pump into zones as well as to heat or cool the solution. Preferably, the chiller and heater Feed Loop are the primary method to chill/heat solution to desired paraments. According to a preferred embodiment of the present invention, there are Kappa analyzers at each stage to allow the determination of the pulping percentage. According to a preferred embodiment of the present invention, there are peroxide analyzers at each stage which allow the operators to determine peroxide consumption. Preferably, the continuous digester has a cone bottom to allow for optimal output discharge.

According to a preferred embodiment of the present invention, the reaction temperature is in the range of 30 to 45° C. since it not only provides consistent remaining peroxide concentration in the final output from the continuous digester, it also provides a consistent lignin-hemicellulose-depolymerized-organic (LHDO) mixture. It also preserves the LHDO from potential oxidation by the hydrogen peroxide ($H_2O_2$). Preferably, the produced LHDO is separated from cellulose. This provides a unique organic stream that can be easily upgraded to a high value renewable fuel.

While the foregoing invention has been described in some detail for purposes of clarity and understanding, it will be appreciated by those skilled in the relevant arts, once they have been made familiar with this disclosure that various changes in form and detail can be made without departing from the true scope of the invention in the appended claims.

The invention claimed is:

1. A process to perform a controlled exothermic delignification on a batch of lignocellulosic biomass, said process comprising:

- providing a system comprising at least a first vessel and a second vessel;
- providing biomass comprising lignin, hemicellulose and cellulose fibers into said first vessel;
- providing an aqueous acidic composition comprising an acid selected from the group consisting of: sulfuric acid; an alkylsulfonic acid; an arylsulfonic acid and combinations thereof;
- providing a modifier component;
- providing a peroxide component;
- exposing said biomass to said acidic composition, said peroxide component and said modifier component to create a reaction mass;
- mixing said reaction mass;
- allowing said acidic composition and peroxide component to come into contact with said biomass for a period of time sufficient for a delignification reaction to occur and remove a pre-determined amount of said lignin from said biomass to form a first treated biomass, wherein said pre-determined amount is assessed by determining a first remaining peroxide concentration in the reaction mass, with a suitable apparatus, when said first remaining peroxide concentration is reached, the first treated biomass is transferred to said second vessel;
- allowing a temperature of the first treated biomass to increase during the residence time of said first treated biomass in said second vessel to a second temperature; and
- allowing said acidic composition, said modifier component and said peroxide component to continue said delignification reaction at said second temperature and remove a second pre-determined amount of said lignin from said first treated biomass to form a second treated biomass, wherein said second pre-determined amount is assessed by testing a second remaining peroxide concentration in the first treated biomass, when said second remaining peroxide concentration is reached, the second treated biomass is removed from said second vessel.

2. The process according to claim 1, wherein said system comprises a third vessel where the second treated biomass is sent to after being removed from said second vessel, and further comprising:

allowing the temperature of the second treated biomass to increase during the residence time of said second treated biomass in said third vessel to a third temperature; and allowing said acidic composition, said modifier component and said peroxide component to continue said delignification reaction at said third temperature and remove a third pre-determined amount of said lignin from said biomass to form a third treated biomass, wherein said third pre-determined amount is assessed by testing a third remaining peroxide concentration in the second treated biomass, when said third remaining peroxide concentration in said second treated biomass is reached, the third treated biomass is removed from said third vessel.

3. The process according to claim 2, where said process requires temperature control at said first vessel, and said second vessel.

4. The process according to claim 3, where said temperature control comprises a heat exchanger, jacketed vessel and baffles.

5. The process according to claim 4, where said temperature control is a heat exchanger, secondary control is a jacketed tank and tertiary control is a baffle.

6. The process according to claim 5, where said system has an outlet which allows the separation of solids from liquids.

7. The process according to claim 6, where said mixing in said first vessel is performed by a recirculation of the reaction mass.

8. The process according to claim 7, further comprising mixing the first treated biomass in said second vessel using a first paddle mixer.

9. The process according to claim 8, further comprising mixing the second treated biomass in said third vessel using a second paddle mixer.

10. The process according to claim 1, where said aqueous acidic composition, said modifier component and said peroxide component collectively form a modified Caro's acid composition selected from the group consisting of composition A; composition B and Composition C;

wherein said composition A comprises:

sulfuric acid in an amount ranging from 20 to 70 wt % of the total weight of the composition;

a modifier component comprising an amine moiety and a sulfonic acid moiety selected from the group consisting of taurine; taurine derivatives; and taurine-related compounds; and a peroxide;

wherein said composition B comprises:

an alkyl sulfonic acid; and a peroxide; wherein the acid is present in an amount ranging from 40 to 80 wt % of the total weight of the composition and where the peroxide is present in an amount ranging from 10 to 40 wt % of the total weight of the composition;

wherein said composition C comprises:

sulfuric acid; and a two-part modifier component comprising:

a compound comprising an amine moiety;

a compound comprising a sulfonic acid moiety; and a peroxide.

11. The process according to claim 1, where the temperature of the reaction mass is maintained at a temperature ranging from 25-45° C.

12. The process according to claim 1, wherein at least part of the resulting liquid portion after coming out of the first is used to treat at least one additional biomass batch.

13. The process according to claim 1, wherein at least part of the resulting liquid portion after coming out of the second vessel is used to treat at least four additional biomass batches.

14. The process according claim 1, wherein at least part of the resulting liquid portion after coming out of the second vessel obtained at the end of the reaction is used to further treat additional biomass batches until the peroxide concentration reaches less than 1%.

15. The process of claim 1, further comprising a washing step to separate a resulting liquid portion comprising said lignin and hemicellulose from the solid portion containing the cellulose extracted from the biomass.

* * * * *